US012392508B1

(12) United States Patent
Lichtenstein et al.

(10) Patent No.: US 12,392,508 B1
(45) Date of Patent: Aug. 19, 2025

(54) HEATING, AIR CONDITIONING, AND DEHUMIDIFICATION ("HACD") SYSTEMS BASED ON LEGACY FORM FACTOR

(71) Applicant: Rockland HAC Corporation, Monroe, NY (US)

(72) Inventors: Zev Lichtenstein, Monroe, NY (US); Isaac Lichtenstein, Monroe, NY (US)

(73) Assignee: Rockland HAC Corporation, Monroe, NY (US)

( * ) Notice: Subject to any disclaimer, the term of this patent is extended or adjusted under 35 U.S.C. 154(b) by 0 days.

(21) Appl. No.: 19/005,075

(22) Filed: Dec. 30, 2024

(51) Int. Cl.
*F24F 1/26* (2011.01)
*F24F 11/65* (2018.01)
*F24F 11/86* (2018.01)

(52) U.S. Cl.
CPC ..... *F24F 1/26* (2013.01); *F24F 11/65* (2018.01); *F24F 11/86* (2018.01)

(58) Field of Classification Search
CPC ..... F25B 2313/02731; F25B 2500/02; F24F 3/153
See application file for complete search history.

(56) References Cited

U.S. PATENT DOCUMENTS 2,515,842 A * 7/1950 Swinburne ..... F24F 3/153 62/411
3,738,117 A * 6/1973 Engel ..... B61D 27/0018 62/90
4,313,313 A * 2/1982 Chrostowski ..... F25B 47/022 62/278
5,092,134 A * 3/1992 Tagashira ..... F25B 13/00 62/278
5,355,690 A * 10/1994 Iritani ..... B61D 27/0018 62/324.4
5,370,307 A * 12/1994 Uehra ..... F25B 30/06 62/512
5,651,258 A * 7/1997 Harris ..... F25B 41/24 62/196.4
5,826,641 A 10/1998 Bierwirth et al.
(Continued)

OTHER PUBLICATIONS

"ComfortStar, Submittal, Split System Cooling," ComfortStar, Feb. 22, 2023.

(Continued)

*Primary Examiner* — Nelson J Nieves
(74) *Attorney, Agent, or Firm* — Weiss & Arons LLP

(57) ABSTRACT

A heating, air conditioning, and dehumidifier ("HACD") system and methods of use are provided. The system may include an outdoor system and an indoor system. The outdoor system may include a compressor, a fully controlled condenser fan, a condenser coil, and a 3-way reheat valve. The indoor system may include a hot gas reheat coil, a thermal expansion valve ("TXV"), a check valve, a metering device, a blower motor, and an evaporator. The HACD system may include a refrigerant and a refrigerant piping system. The refrigerant piping system may include a first pipe being a compressor discharge pipe, a second pipe, a third pipe, and a fourth pipe being a suction line pipe. The indoor system may be configured to be confined to a form factor footprint such that physical dimensions of the indoor system are less than or equal to about 28×25.5×52 inches.

20 Claims, 5 Drawing Sheets

(56) References Cited

U.S. PATENT DOCUMENTS

| | | | | |
|---|---|---|---|---|
| 6,666,040 | B1 * | 12/2003 | Groenewold | F25B 41/24 62/90 |
| 6,792,767 | B1 | 9/2004 | Pargeter et al. | |
| 7,275,384 | B2 * | 10/2007 | Taras | F24F 3/153 62/159 |
| 9,964,346 | B2 * | 5/2018 | Hua | F25B 49/02 |
| 10,948,203 | B2 * | 3/2021 | Blanton | F25B 29/003 |
| 11,378,290 | B2 * | 7/2022 | Locke | F25B 49/02 |
| 11,965,672 | B2 * | 4/2024 | Locke | F24F 3/153 |
| 12,055,316 | B2 * | 8/2024 | Olivera | F25B 41/20 |
| 2011/0079032 | A1 * | 4/2011 | Taras | F24F 3/153 62/324.2 |
| 2013/0180274 | A1 * | 7/2013 | Tamaki | F25B 49/027 62/126 |
| 2016/0146477 | A1 * | 5/2016 | Jewell | F24F 3/153 62/173 |
| 2017/0343232 | A1 * | 11/2017 | Price | F24F 5/0046 |
| 2019/0107299 | A1 * | 4/2019 | Locke | F25B 49/02 |
| 2019/0178509 | A1 * | 6/2019 | Taras | F25B 30/02 |
| 2019/0368754 | A1 * | 12/2019 | Blanton | G05D 23/1919 |
| 2020/0378630 | A1 * | 12/2020 | Kalambe | F24F 3/153 |
| 2022/0299215 | A1 * | 9/2022 | Locke | F25B 30/06 |
| 2022/0381483 | A1 * | 12/2022 | Gyotoku | F25B 13/00 |
| 2024/0219036 | A1 * | 7/2024 | Ghodosi | F24F 1/0083 |
| 2024/0219082 | A1 * | 7/2024 | Qiu | F25B 39/04 |
| 2025/0012493 | A1 * | 1/2025 | Koike | F25B 41/20 |

OTHER PUBLICATIONS

"DXair Pool Dehumidifiers LV Series ½ to 6 Ton G-60 Galvanized," DXair LV Series, Jul. 2020.

"DXair Pool Dehumidifiers MC Series 30 to 60 Tons G-60 Galvanized," DXair LV Series, Jul. 2020.

"DXair Indoor Pool Dehumidification Systems Stainless Steel Series 2-20 Tons," DX air SS Series, Jul. 2020.

"HBXB-HW Series: Hydronic Air Handler Without Pump," First Co. Retrieved Aug. 4, 2024.

"Sporlan 3-Way Valves," www.sporlan.com, Bulletin 30-20, Apr. 2007.

* cited by examiner

HEATING, AIR CONDITIONING, AND DEHUMIDIFICATION ("HACD") SYSTEMS BASED ON LEGACY FORM FACTOR

FIELD OF TECHNOLOGY

Aspects of the disclosure relate to heating, air conditioning, and dehumidification ("HACD") systems.

BACKGROUND OF THE DISCLOSURE

Typical HACD systems have compressor units located only indoors. These typical HACD configurations may have several drawbacks.

First, compressor units are usually located separately as indoor units. These indoor compressor units therefore occupy much-needed indoor space.

Second, compressor units are loud. Compressor units located indoors can keep people awake and cause undue stress because of noise volume.

Third, compressor units are not efficient. Because efficiency of the indoor compressor units is poor, indoor compressor units cause excessive energy consumption. Excess energy consumption can be costly.

Fourth, compressor units are not easily installable. HACD system installers are accustomed to installing standardized equipment designed for standardized spaces. To require HACD professionals to install an entirely separate unit is challenging for both HACD installers and customers who must pay for these services.

Therefore, it would be desirable to include the indoor compressor unit in an outdoor unit.

It would also be desirable to achieve a smaller system footprint while maintaining a standard form factor. HACD system engineers and contractors do not typically deviate from practical installation practices. Therefore, it would be desirable to provide a system with a form factor and footprint size that engineers and contractors typically use.

It would be even further desirable to provide and efficient HACD systems with a dehumidification mode, within a confined form factor footprint, that will continue dehumidifying while space cooling is already satisfied.

SUMMARY OF THE DISCLOSURE

FIG. 1 shows how an AC and heat pump system work in general. A typical AC system may include an evaporator 102 (EV). A typical AC system may include compressor 104. A typical AC system may include metering device 106. A typical AC system may include condenser 108 (COND).

Evaporator 102 may transport, via, e.g., "Lo" pressure, refrigerant to compressor 104. Compressor 104 may transport, via, e.g., "Hi" pressure, refrigerant to condenser 108. Condenser 108 may transport, via, e.g., "Hi" pressure, refrigerant to metering device 106. Metering device 106 may transport, via, e.g., "Lo" pressure, refrigerant to evaporator 102.

A direction of flow of the refrigerant through a typical AC system may be, e.g., as follows: (1) from evaporator 102 to compressor 104; (2) from compressor 104 to condenser 108; (3) from condenser 108 to metering device 106; and (4) from metering device 106 to evaporator 102.

A typical heat pump system may include indoor coil 112 (EV known as ("k.a.") evaporator). A typical heat pump system may include compressor 110. A typical heat pump system may include metering device 114. A typical heat pump system may include 4-way valve 116. A typical heat pump system may include outdoor coil (COND k.a. condenser) 118.

Indoor coil (EV) 112 acting as a condenser may transport, via, e.g., "Hi" pressure, refrigerant to metering device 114. Metering device 114 may transport, via, e.g., "Lo" pressure, refrigerant to outdoor coil acting as evaporator (COND k.a. condenser) 118. Outdoor coil acting as evaporator (COND k.a. condenser) 118 may transport, via, e.g., "Lo" pressure, refrigerant to compressor 110, coupled via 4-way valve 116. Compressor 110 may transport, via, e.g., "Hi" pressure, refrigerant to Indoor coil 112 (EV k.a. evaporator), coupled via 4-way valve 116.

A direction of flow of the refrigerant through a typical heat pump system may be, e.g., as follows: (1) from indoor coil 112 (EV k.a. evaporator) to metering device 114; (2) from metering device 114 to outdoor coil acting as evaporator (COND k.a. condenser) 118; (3) from outdoor coil acting as evaporator (COND k.a. condenser) 118 to compressor 110, via 4-way valve 116; and (4) from compressor 110 to indoor coil (EV) 112 acting as a condenser, via 4-way valve 116.

HACD systems and methods of use are provided. HACD systems and methods incorporating a dehumidifier with an A/C and heating unit are provided.

The HACD system and methods may include three modes: (1) an AC mode; (2) a heating mode; and (3) a dehumidification mode. The three modes may provide three refrigerant flow sequences. The AC mode may provide cool air in a first refrigerant flow sequence. The heating mode may provide warm air in a second refrigerant flow sequence. The dehumidification mode may provide natural dry air in a third refrigerant flow sequence.

In the AC mode, the HACD system may cool down space air (e.g., ambient air and/or air in the vicinity of the HACD system). Space air may enter the HACD system. Space air may be cooled via air being circulated over (EV) cooling coil included in the HACD system. The cooling coils may include a refrigerant. The refrigerant included in the (EV) cooling coil may be reduced to a lower pressure to cool down the space air. As the refrigerant is reduced to a lower pressure, moisture from the space air may condense over the cooling coil and thereby may be removed from the space air.

In the dehumidification mode, adding to the embodiment as set forth herein, the HACD system may dehumidify the ambient air without substantially increasing and/or decreasing the temperature of the air. In the dehumidification mode, ambient air may enter the HACD system. Moisture may be condensed out of the ambient air using the cooling coils. As the ambient air is cooled, the temperature of the ambient air may drop. The HACD system may reheat the cooled ambient air using reheat coils. The reheat coils may reheat the temperature of the cooled ambient air back to its original temperature.

The HACD systems and methods may include an HACD system with a confined footprint. The HACD systems and methods of use may be installed and employed by agents, contractors, and engineers that handle typical heating, air conditioning ("AC"), and/or dehumidification systems. The HACD systems and methods of use may be configured for enhanced energy efficiency. The HACD systems and methods of use may be configured for indoor and/or outdoor noise reduction.

The HACD systems and methods may include an outdoor system. The outdoor system may include a compressor. The outdoor system may include a condenser. The outdoor system may include a fully controlled condenser fan. The outdoor system may include a condenser coil. The outdoor system may include a 3-way reheat valve, controls, etc.

The HACD systems and methods may include an indoor system. The indoor system may include an evaporator. The indoor system may include a hot gas reheat coil. The indoor system may include a thermal expansion valve ("TXV"). The TXV may control an amount of refrigerant released into the evaporator. The TXV may regulate a temperature of refrigerant that flows out of the evaporator.

The indoor system may include a check valve. The indoor system may include a metering device. The indoor system may include a blower motor.

The HACD systems and methods may include a refrigerant piping system. The refrigerant piping system may be configured to transport refrigerant throughout the HACD system.

The refrigerant piping system may include a first pipe. The first pipe may be a compressor discharge pipe. The first pipe may be coupled from the compressor to the 3-way reheat valve. The 3-way reheat valve may be configured to output refrigerant to the hot gas reheat coil.

The refrigerant piping system may include a second pipe. The second pipe may be coupled, via the check valve, from the hot gas reheat coil to the condenser coil.

The refrigerant piping system may include a third pipe. The third pipe may be coupled, via the metering device, from an outlet of the condenser coil to an input of the evaporator.

The refrigerant piping system may include a fourth pipe. The fourth pipe may be a suction line pipe. The fourth pipe may be coupled from an outlet of the evaporator to an input of the compressor. The fourth pipe may be configured to output the refrigerant to the compressor.

In some embodiments, the indoor system may be configured to a confined form factor footprint. For example, the physical dimensions of the indoor system may be less than or equal to about 60×30×30 inches.

BRIEF DESCRIPTION OF THE DRAWINGS

The objects and advantages of the invention may be apparent upon consideration of the following detailed description, taken in conjunction with the accompanying drawings, in which like reference characters refer to like parts throughout.

DETAILED DESCRIPTION OF THE DISCLOSURE

Figure 1:
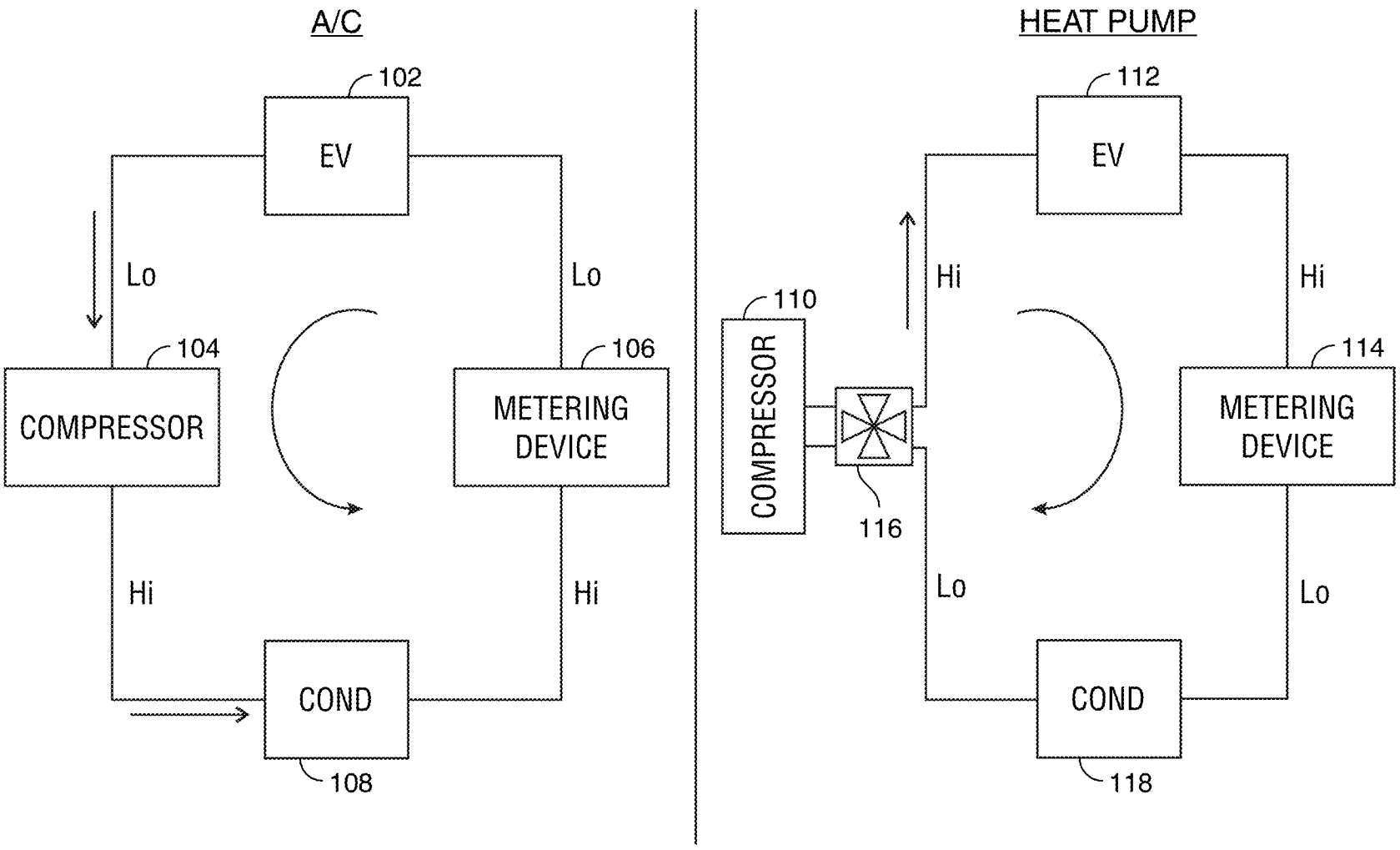
FIG. 1 shows an illustrative diagram of an AC and heat pump system.

HACD systems and methods of use are provided.

HACD systems and methods of use may include 3 different operational modes. The 3 different operational modes may include: (1) cooling (AC); (2) heating (same as AC with reverse cycle integral valves that move a refrigerant in a different direction); and (3) dehumidification.

HACD systems and methods may include dehumidification control for humidity and AC control for temperature. Normally, cooling control is a priority. HACD systems and methods may include dehumidification control that is not a priority.

HACD systems and methods may standardize a split dehumidification system (with an outdoor condenser and an indoor air handler with reheat coil capabilities).

The HACD systems and methods may include a thermostat main bar. The thermostat main bar may include a cooling mode option, a heating mode, and a dehumidification option. The HACD systems and methods may include all three modes in the same indoor unit without losing any efficiency.

The HACD systems and methods may be configured to use the compressor while switching between the modes (heating, cooling, and dehumidification). The HACD systems may be configured to not use the compressor for mode changes, thereby avoiding compressor delays.

An AC system normally dehumidifies while simultaneously cooling because the AC removes moisture from the air. Thus, HACD systems and methods may include dehumidification without cooling. And in some embodiments, HACD systems and methods may be used at room temperature in active dehumidification mode.

In some embodiments, HACD systems and methods may remove excess heat. While in the dehumidification mode, the condenser may accumulate enough cooling to overcome compressor heat loss. The condenser may gain cooler temperature supply air while in dehumidification mode. The HACD systems and methods may not lose any heat while running cooling, heating, and dehumidification modes.

The HACD systems and methods may achieve full capacity with a third of the space compared to typical AC and dehumidification systems with similar British Thermal Unit ("BTU") capacity (e.g., the footprint or volume of the equipment may be about one third that of typical systems with similar capacity). The HACD systems and methods may include a form factor footprint of physical dimensions not greater than, e.g., 28"×25.25"×52".

HACD systems and methods may include coils. The coils may include pipes, e.g., copper pipes and aluminum pipes. The pipes may include fins.

HACD systems and methods may include a hot gas reheat coil. HACD systems and methods may include a cooling coil. The cooling coil may cause cooling by dehumidification (e.g., condensation from the air). HACD systems and methods may include the hot gas reheat coil to offset the cooling caused by the cooling coil, which is caused by the dehumidification (e.g., the condensation from the air).

The HACD systems and methods may include a hot gas reheat line, for example, the hot gas reheat coil, pipe, and valve. A typical AC and dehumidification system may include a compressor, a 4-way valve, an accumulator, a TXV, and loop for refrigerant or liquid to circulate, however may not have a hot gas reheat line. The hot gas reheat line may include refrigerant that arrives hot. The hot gas reheat line may include refrigerant that outputs hot gas. The hot gas may be hot and/or slightly warm.

The gas reheat line may be insulated. The gas reheat line may be insulated to maintain a temperature. The HACD systems and methods may handle outdoor ambient air. The hot gas reheat coil may heat the outdoor ambient air. The hot gas reheat coil may blow the heated outdoor ambient air back into the conditioned space.

HACD systems and methods may bring hot gas from the outside unit to the inside. Cooled air from the HACD system may be tempered with heat from the hot gas reheat coil of the HACD system. HACD systems and methods may then produce neutral-temperature air (e.g., room temperature or 20±5° C.) to dehumidify space air.

The HACD systems and methods may include a condenser. HACD systems and methods may include a fully controlled condenser fan. HACD systems and methods may include a condenser coil. The fully controlled condenser fan may be configured to transport air over the condenser coil.

The HACD systems and methods may include two condenser coils. The HACD systems and methods may include a first condenser coil. The first condenser coil may be cold. The HACD systems and methods may include a second condenser coil. The second condenser coil may be hot.

HACD systems and methods may include an evaporator. The evaporator (also referred to as an evaporator coil) may be cold to touch because it may extract heat from ambient air. The evaporator may become cold immediately because heat may pass through a wall of the evaporator pipe and into refrigerant inside the evaporator pipe. The condenser may be hot to touch because the condenser may extract cold from the air, thereby cooling refrigerant within the condenser pipe. The evaporator coil and indoor condenser coil may be located within the same cabinet in the indoor system. The condenser may be located on top of the HACD systems. The evaporator may be located on the bottom of the HACD systems.

The HACD systems and methods may include a compressor. The compressor may be a pump that circulates a chemical refrigerant. The compressor may pump heated refrigerant from the evaporator coil to the condenser coil. The compressor may be located outdoors. The compressor may include a condenser coil. The condenser coil may be configured to operate in dehumidification mode. The condenser coil may not use electric heat.

HACD systems and methods may include a hot gas reheat coil that is configured to become the first condenser coil. For efficiency, HACD systems and methods may not expel heat outside. HACD systems and methods may therefore use heat within the same system to conserve energy.

HACD systems and methods may include using both the condenser coil and the hot gas reheat coil simultaneously to achieve the desired form factor footprint. By contrast, typical AC and dehumidification systems will not use the outdoor condenser coil while dehumidifying. The simultaneous use of both the condenser coil and the hot gas reheat coil in the HACD systems and methods may reduce energy consumption.

HACD systems and methods may modulate automatically between the hot gas reheat coil and the condenser coils. HACD systems and methods may not require modulation between the hot gas reheat coil and the outdoor condenser coil. This may lead to less servicing, maintenance, and mechanics required for the system.

HACD systems and methods may include a heat pump. HACD systems and methods may include a variable-speed compressor. HACD systems and methods may include a 3-way heat reclaim valve. The 3-way heat reclaim valve may avoid compressor interruption while switching between cooling, heating, and/or dehumidification modes. HACD systems and methods may be controllable with, e.g., remote controls and digital applications.

HACD systems and methods may include a metering device. The metering device may include an orifice and/or other types of devices used in refrigeration and air conditioning systems. The orifice may restrict a flow of the refrigerant within the system. The orifice may have a diameter between any suitable range, e.g., about 0.1 mm to about 10 mm. The metering device may restrict the flow of hot refrigerant to the condenser.

The compressor may create high pressure at the metering device. Pressure may be higher within the coils between the metering device, condenser coils and the compressor. Pressure may be lower within the coils between the metering device, the evaporator coil, and the compressor.

HACD systems and methods may include an air handler. The air handler may include the evaporator.

In some embodiments, the evaporator coil may be configured to become the condenser. In some embodiments the condenser may be configured to become the evaporator coil.

HACD systems and methods may include a 3-way valve. The 3-way valve may be a hot gas reheat valve. The 3-way valve may feed the refrigerant through a heat coil to the outdoor condenser.

In some embodiments, HACD systems and methods may include a 4-way valve. The 4-way valve may reverse a flow of refrigerant in the HACD system.

HACD systems and methods may include a suction line. The suction line may include a pipe with an inner width between about ⅜" to ⅞" in diameter.

HACD systems and methods may include a 1-way valve. The 1-way valve may be a check valve. The 1-way valve may direct a flow of refrigerant from the compressor to the inlet of the hot gas reheat coil. The hot gas reheat coil may release the heat from itself to the surroundings. The check valve may control the flow of refrigerant from the hot gas reheat coil to the condenser coil. The condenser coil may be used for additional heat rejection of the refrigerant from the hot gas reheat coil.

HACD systems and methods may include a blower motor. The blower motor may be configured to transport air over the evaporator.

HACD systems and methods may include a TXV. The TXV may be configured to control an amount of refrigerant released into the evaporator.

HACD systems and methods may include control feedback circuitry. HACD systems and methods may include humidity control from 0-100% humidity. 40-60% humidity may be a normal range of humidity indoors. 50% humidity may be an optimal humidity level for human comfort.

The HACD systems and methods may include an accumulator. The accumulator may act as a receiver during heating and defrost cycles when system imbalance or an overcharge from field service could result in excessive liquid refrigerant in the system. The accumulator may store the refrigerant until needed and feed it back to the compressor at an acceptable rate.

The HACD systems and methods for indoor sections may occupy varying physical dimensions and form factor footprints. For example, the HACD systems and methods may include forms with capacities up to 2 tons, 3 tons, 4 tons, and 5 tons. The HACD systems up to 2 tons may occupy a form factor footprint of 20"×20"×40". The HACD systems up to 3 tons may occupy a form factor footprint of 23"×20"×42". The HACD systems up to 4 tons may occupy a form factor footprint of 28"×21.25"×48". The HACD systems up to 5 tons may occupy a form factor footprint of 28"×25.25"×52". The HACD systems and methods may preferably occupy a form factor footprint of not greater than 28"×25.25"×52".

The HACD systems may not be custom built. The HACD systems may be produced in standardized forms. The HACD systems may be standardized to standard unit sizes and form factor footprints. The HACD systems may not include a modulator valve. Modulator valves may be commonly used in AC and dehumidification systems.

The HACD systems and methods may include an indoor system. The HACD systems and methods may include an outdoor system. The HACD systems and methods may include a compressor. The compressor may be deployed in the outdoor system to avoid losing space indoors. An system with an indoor compressor may be confined inside a residential, commercial, or industrial site to a standardized form factor, footprint, and size. Further, using a compressor outdoors has an added advantage of avoiding compressor noise caused by indoor use.

The indoor and outdoor systems may include a refrigerant. The indoor and outdoor systems may include a refrigerant piping system. The refrigerant piping system may be deployed to transport the refrigerant throughout the indoor and outdoor systems.

The outdoor system may include an outdoor condenser. The outdoor system may include the fully controlled compressor. The outdoor system may include the fully controlled condenser fan. The condenser may include the first condenser coil. The outdoor system may include the 3-way reheat valve. The outdoor system may include the 4-way valve.

The indoor system may include an evaporator. The indoor system may include an evaporator coil.

The indoor system may include a hot gas reheat coil. The indoor system may include a hot gas reheat valve. The indoor system may include an indoor condenser. The indoor condenser may include a second condenser coil. The hot gas reheat valve may activate an indoor condenser. Refrigerant, passing through the hot gas reheat coil, may be heated by the hot gas reheat coil. The refrigerant may be heated up to about, e.g., 120° C.

The indoor system may include a TXV. The indoor system may include a check valve. The indoor system may include a metering device. The indoor system may include a blower motor.

The hot gas reheat coil may be located above a blower motor. The hot gas reheat coil may be located a threshold distance away from the evaporator, thereby avoiding heat loss that would occur if the hot gas reheat coil and evaporator coil were adjacent or close to each other.

The condenser may include four pipes. The four pipes may include two pipes for conventional cooling and or heat pump. The four pipes may include two pipes for heat extraction. The four pipes may be included in the refrigerant piping system.

The refrigerant piping system, and method of use thereof, may include a first pipe. The refrigerant may move through the first pipe. The first pipe may be a compressor discharge pipe. The first pipe may be coupled from the compressor to the 3-way reheat valve. The 3-way reheat valve may be configured to output the refrigerant to the outdoor condenser coil and the hot gas reheat coil. In some embodiments, the 3-way reheat valve may be configured to output the refrigerant to the condenser coil.

The refrigerant piping system, and method of use thereof, may include a second pipe. The refrigerant may move through the second pipe. The second pipe may be coupled, via the check valve, from the hot gas reheat coil to the outdoor condenser coil. The check valve may be configured to output the refrigerant to the condenser coil.

The refrigerant piping system, and method of use thereof, may include a third pipe. The third pipe may be coupled, via the metering device, from an outlet of the condenser coil to an input of the evaporator. The metering device may be configured to output the refrigerant to the evaporator.

The refrigerant piping system, and method of use thereof, may include a fourth pipe. The fourth pipe may be a suction line pipe. The fourth pipe may be coupled from an outlet of the evaporator to an input of the compressor. The fourth pipe may be configured to output the refrigerant to the compressor.

The HACD systems and methods may include a loop. The loop may be used for circulating pool water. The loop may carry a refrigerant or liquid to boiler inlet and or a reheat coil, to reuse the energy of the heat where needed.

The indoor system may be configured to be confined to a form factor footprint. For example, the physical dimensions of the indoor system may be less than or equal to about 30×30×60 inches.

Systems and methods described herein are illustrative. Systems and methods in accordance with this disclosure may now be described in connection with the figures, which form a part hereof. The figures show illustrative features of systems and method steps in accordance with the principles of this disclosure. It is to be understood that other embodiments may be utilized, and that structural, functional and procedural modifications may be made without departing from the scope and spirit of the present disclosure.

The steps of methods may be performed in an order other than the order shown or described herein. Embodiments may omit steps shown or described in connection with illustrative methods. Embodiments may include steps that are neither shown nor described in connection with illustrative methods.

Illustrative method steps may be combined. For example, an illustrative method may include steps shown in connection with another illustrative method.

Systems may omit features shown or described in connection with illustrative systems. Embodiments may include features that are neither shown nor described in connection with the illustrative systems. Features of illustrative systems may be combined. For example, an illustrative embodiment may include features shown in connection with another illustrative embodiment.

Figure 2A:
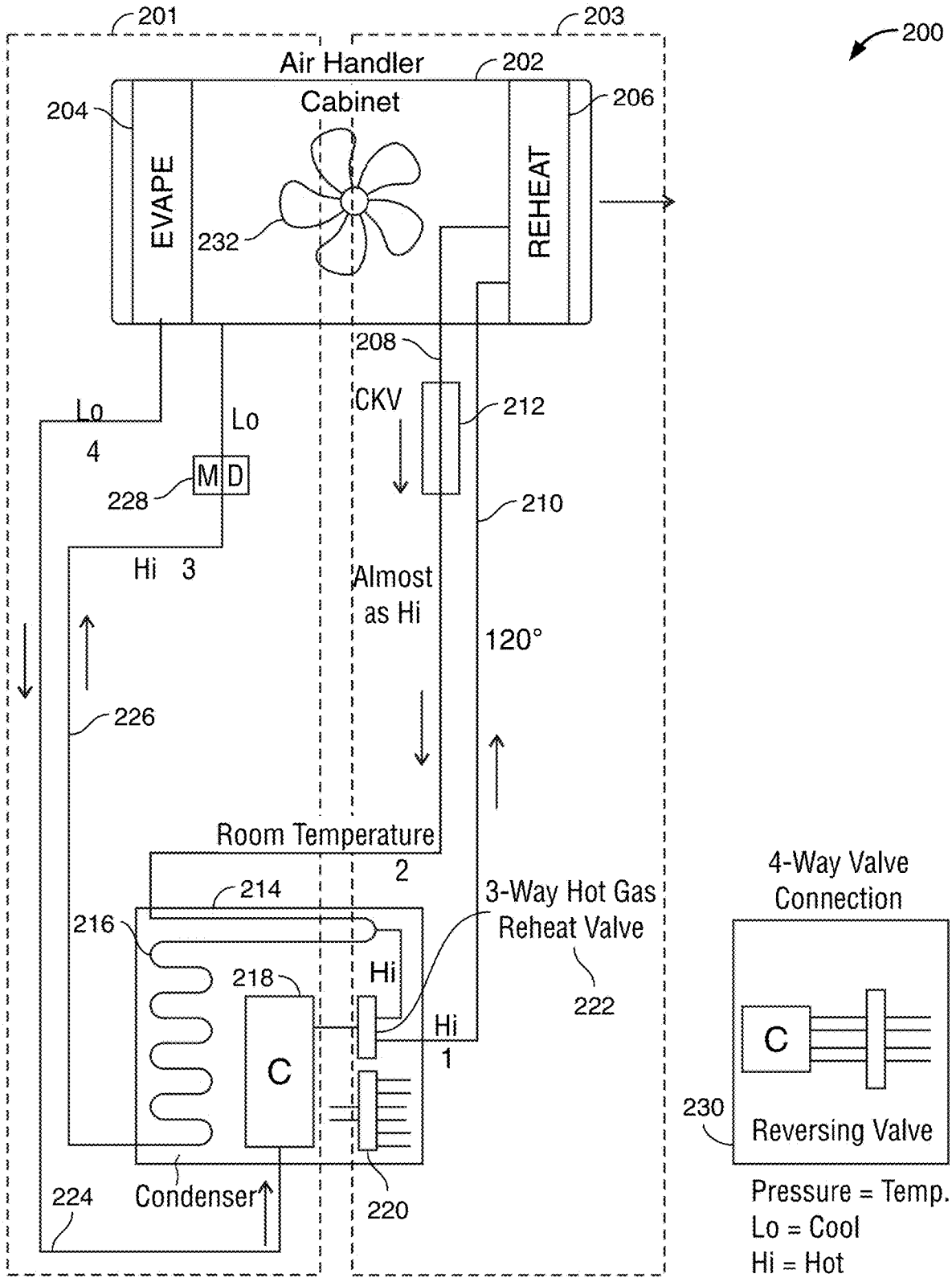
FIG. 2A shows an illustrative diagram of a HACD system in accordance with principles of the disclosure.

FIG. 2A shows an illustrative diagram of HACD system 200.

Figure 2B:
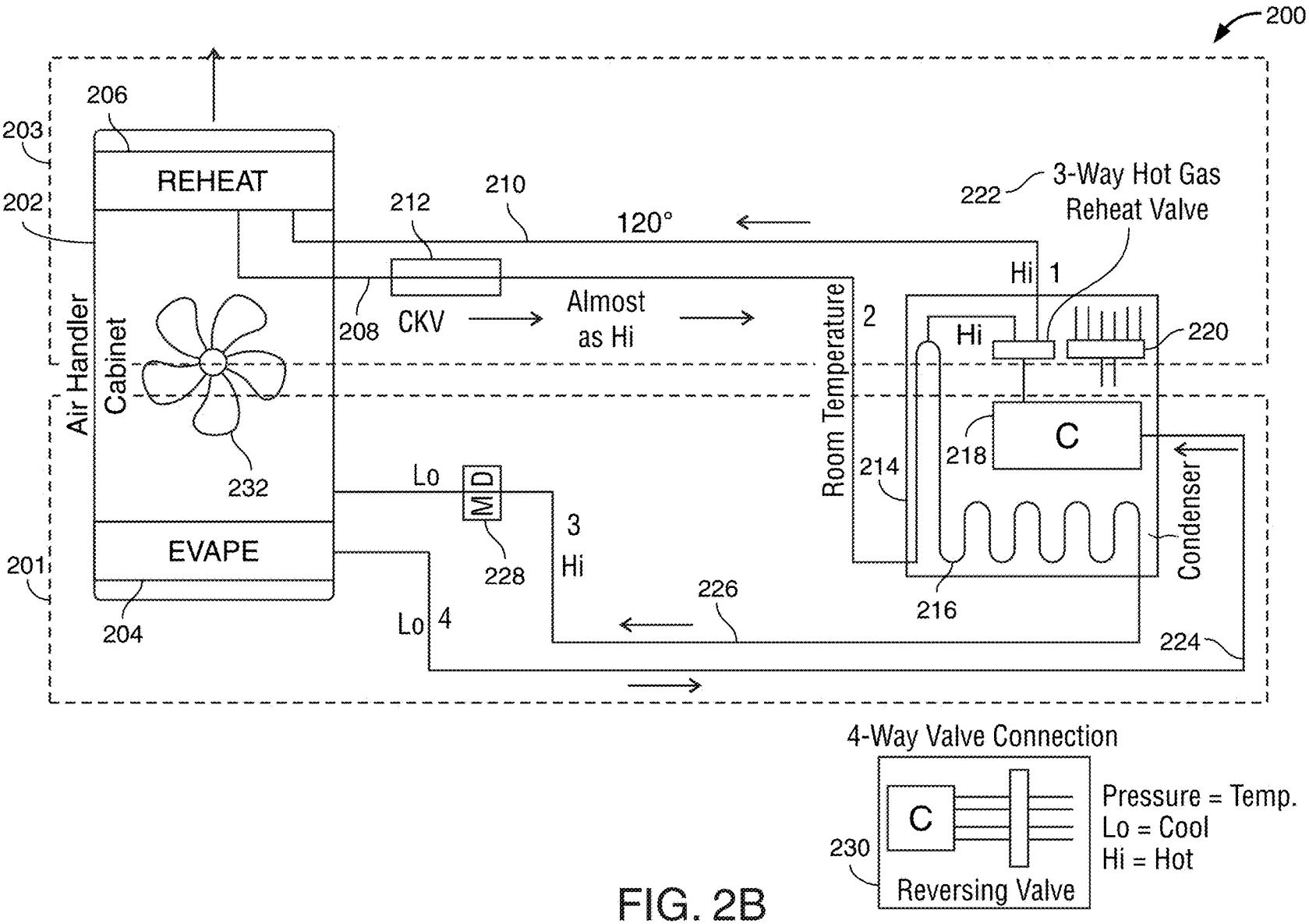
FIG. 2B shows an illustrative diagram of a HACD system in accordance with principles of the disclosure.

FIG. 2B shows an illustrative diagram of HACD system 200. HACD system 200 is identical to HACD system 200 in FIG. 2A. However, HACD system 200 shown in FIG. 2B shows HACD system 200 in a horizontal position.

HACD system 200 may include loop 201. Loop 201 may include an AC/heating loop. HACD system 200 may include loop 203. AC/heating may be provided through third pipe (3) 126 and fourth pipe (4) 124, included in loop 201. Loop 203 may include a dehumidification loop. Dehumidification may be provided via first pipe (1) 210 and second pipe (2) 208, included in loop 203.

HACD system 200 may include air handler cabinet 202. Air handler cabinet 202 may include evaporator 204. Air handler cabinet 202 may be a cabinet used to hold devices that regulate and circulate air in HACD system 200. Evaporator 204 may be a heat exchanger device that transfers heat from its surroundings (e.g., ambient air) into a refrigerant causing a phase change (i.e., evaporation). The refrigerant may be a fluid used to undergo repeated phase transitions between a liquid and a gas.

Air handler cabinet 202 may include hot gas reheat coil 206. Hot gas reheat coil 206 may be used during an HACD cooling cycle to dehumidify cool air coming from evaporator 204. A portion of refrigerant going to condenser 214 in HACD system 200 may be rerouted to the hot gas reheat coil 206. The refrigerant may be reheated at the hot gas reheat coil 206. Hot gas reheat coil 206 may then heat ambient air via the reheated refrigerant. In some embodiments, most or all refrigerant may be sent to hot gas reheat coil 206 for reheating. In some embodiments, hot gas reheat coil 206 may use high pressure, high temperature compressor discharge gas to reheat air leaving evaporator 204.

Air handler cabinet 202 may include blower motor 232. Blower motor may help transport air throughout HACD system 200. Hot gas reheat coil 206 may emit air and refrigerant to the outside of air handler cabinet 202.

HACD system 200 may include condenser 214. Condenser 214 may be a heat exchanger device used to condense a gas into a liquid through cooling. Condenser 214 may include condenser coil 216. Condenser coil 216 may release heat that was absorbed by evaporator 204.

Condenser 214 may include compressor 218 (C). Compressor 218 may pressurize refrigerant in the HACD system, thereby turning incoming refrigerant into hot, high-pressured gas. Compressor 218 may push the refrigerant through a refrigerant piping system included in HACD system 200.

The refrigerant piping system may include four pipes. The four pipes may include two pipes for conventional cooling (e.g., second pipe (2) 208 and third pipe (3) 226) and two pipes for heat extraction (e.g., first pipe (1) 210 and fourth pipe (4) 224).

HACD system 200 may include 4-way valve 220. 4-way valve 220 may be connected to compressor 218. 4-way valve 220 may include a 4-way valve connection. The 4-way valve connection may be reversing valve 230. 4-way valve 220 or reversing valve 230 may be used to reverse the heating/cooling cycle of HACD system 200.

Pressure level inside the pipes in the refrigerant piping system may be indicated by "Lo" or "Hi." "Lo" pressure may indicate relatively lower pressure in a pipe. "Hi" pressure may indicate relatively higher pressure in a pipe. In some embodiments, "Lo" pressure may correspond to a relatively cooler temperature of refrigerant in a pipe. In some embodiments, "Hi" pressure may correspond to a relatively hotter temperature of refrigerant in a pipe.

Compressor 218 may transport, via first pipe (1) 210, hot refrigerant to hot gas reheat coil 206. First pipe (1) 210 may be a compressor discharge pipe. The hot refrigerant may be about 120° C.

First pipe (1) 210 may be coupled from compressor 218 to 3-way hot gas reheat valve 222. 3-way hot gas reheat valve 222 may divert refrigerant from entering condenser coil 216 to hot gas reheat coil 206, thereby reheating the circulating space air. 3-way hot gas reheat valve 222 may be configured to output the refrigerant to condenser coil 216 and/or hot gas reheat coil 206.

Compressor 218 may transport, via first pipe (1) 210, refrigerant to hot gas reheat coil 206, through 3-way hot gas reheat valve 222. The pressure in the first pipe (1) 210 may be "Hi."

Hot gas reheat coil 206 may transport, via second pipe (2) 208 and an internal pipe inside condenser 214, refrigerant to compressor 218, through 3-way hot gas reheat valve 222. Second pipe (2) 208 may be coupled via check valve 212 (CKV). Check valve 212 may be a one-way valve. Check valve 218 may allow flow through it in only one direction. Check valve 212 may be configured to output the refrigerant to compressor 218.

The pressure in second pipe (2) 208 may be almost as "Hi" as the pressure in first pipe (1) 210. The temperature in second pipe (2) 208 may vary according to HACD system mode and environmental conditions. The pressure in the internal pipe inside condenser 214 transporting the refrigerant through hot gas reheat valve 222 to compressor 218 may be "Hi."

Condenser coil 216 may transport refrigerant from an outlet, via a liquid receiver (not illustrated) in a third pipe (3) 226, to evaporator 204. Third pipe (3) 226 may be coupled via metering device 228 (M|D). The metering device 228 may be a device that decreases the temperature and pressure of the refrigerant moving from condenser 214 before it enters evaporator 204. The metering device 228 may output the refrigerant to evaporator 204. The metering device 228 may alter the pressure inside third pipe (3) 226 from "Hi" to "Lo."

Evaporator 204 may transport refrigerant from an outlet, via fourth pipe (4) 224, which may be called a suction line pipe, to compressor 218. Fourth pipe (4) 224 may be coupled with a suction line accumulator (not illustrated). The suction line pipe may be a refrigerant pipe that runs under low pressure to the compressor 218.

Fourth pipe (4) 224 may be coupled from an outlet of evaporator 204 to an input of compressor 218 coupled with a suction line accumulator (not illustrated). Fourth pipe (4) 224 may be configured to output the refrigerant to compressor 218.

A direction of flow of refrigerant through the refrigerant piping system may be, e.g., as follows: (1) the refrigerant may flow, via first pipe 210 (1) from an outlet of compressor 218 through 3-way hot gas reheat valve 222 into an input of hot gas reheat coil 206; (2) the refrigerant may flow, via second pipe 208 (2) from an outlet of hot gas reheat coil 206 through check valve 212 into an input of the condenser coil 216; (3) the refrigerant may flow, via third pipe 226 (3) from an outlet of condenser coil 216 through metering device 228 into an input of the evaporator 204; and (4) the refrigerant may flow, via fourth pipe 224 (4) from an outlet of evaporator 204 into an input of compressor 218.

Figure 3:
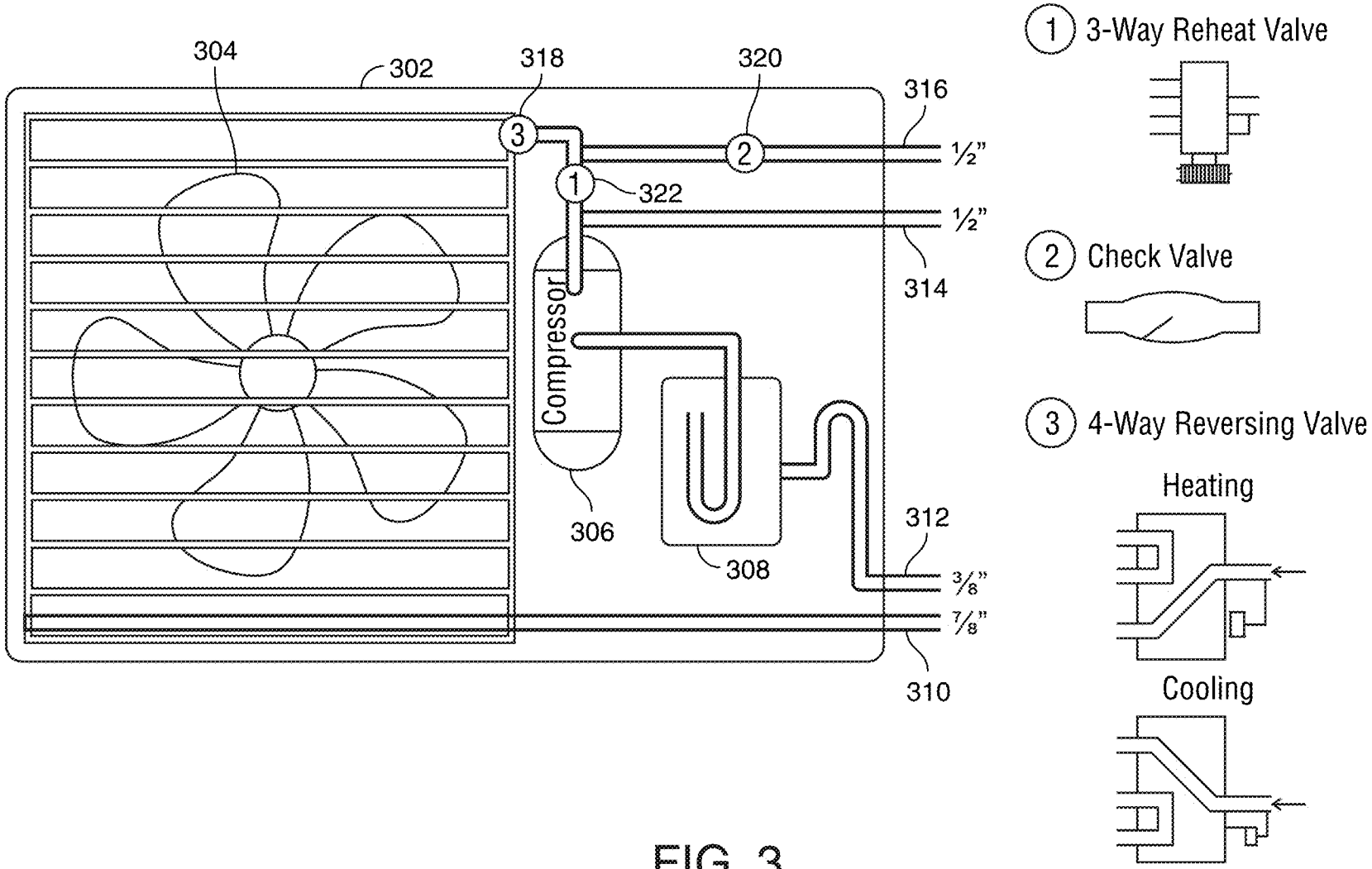
FIG. 3 shows an illustrative diagram of an outdoor section of the HACD system in accordance with the disclosure.

FIG. 3 shows an illustrative diagram of HACD system according to the embodiments. The HACD system may be installed outdoors.

The HACD system may include outdoor system 302. Outdoor system 302 may have one or more features in common with HACD system 200. Outdoor system 302 may include fully controlled condenser fan 304. Outdoor system 302 may include compressor 306. Outdoor system 302 may include condenser coil 308. Outdoor system 302 may include 3-way reheat valve (1) 322 (also referred to as a 3-way hot gas reheat valve).

Compressor 306 may be coupled to fully controlled condenser fan 304 via 3-way reheat valve (1) 322. Compressor 306 may be coupled to fully controlled condenser fan 304 via 4-way reversing valve (3) 318. 4-way reversing valve (3) 318 may provide both heating and cooling (airflow going the opposite direction to heating).

Outdoor system 302 may include a connection to an indoor system. Outdoor system 302 may include a refrigerant piping system. The refrigerant piping system may be connected to the indoor system. The refrigerant piping system may include first pipe 314. The refrigerant piping system may include second pipe 316. The refrigerant piping system may include third pipe 312. The refrigerant piping system may include fourth pipe 310.

First pipe 314 may include an inner pipe diameter of about ½". Second pipe 316 may include an inner pipe diameter of about ½". Third pipe 312 may include an inner pipe diameter of about ⅜". Fourth pipe 310 may include an inner pipe diameter of about ⅞".

First pipe 314 may have one or more features in common with first pipe (1) 110. Second pipe 316 may have one or more features in common with second pipe (2) 108. Third pipe 312 may have one or more features in common with third pipe (3) 126. Fourth pipe 310 may have one or more features in common with fourth pipe (4) 124.

Figure 4:
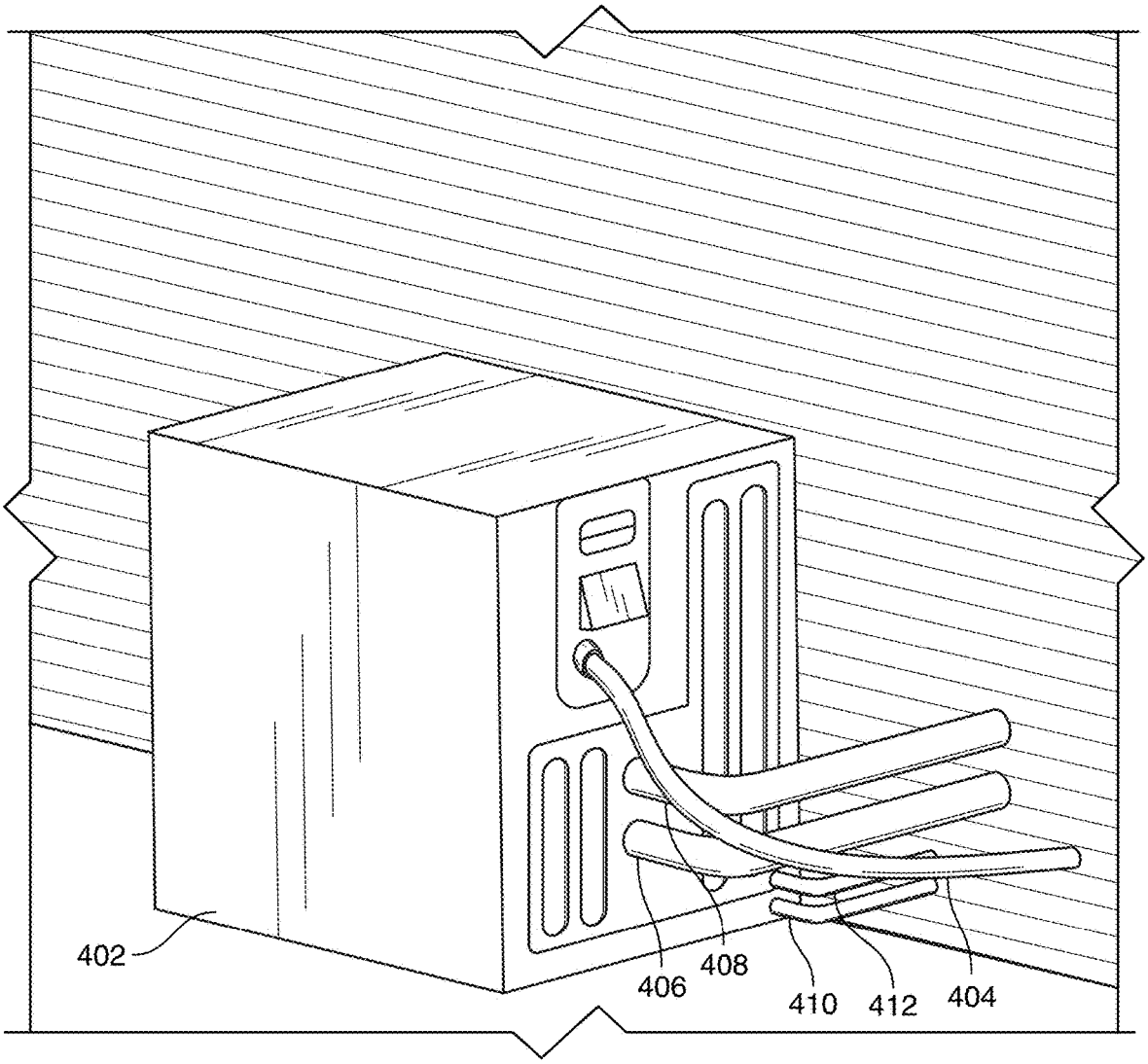
FIG. 4 shows another illustrative diagram of an outdoor HACD system in accordance with the disclosure.

FIG. 4 shows an illustrative diagram of outdoor HACD system 402 according to the embodiments. Outdoor HACD system 402 may have one or more features in common with one or more of HACD system 200 and outdoor HACD system 302.

Outdoor HACD system 402 may include electric conduit 404. Outdoor HACD system 402 may include a refrigerant piping system.

The refrigerant piping system may include four pipes. The refrigerant piping system may include first pipe 410. The refrigerant piping system may include second pipe 412. The refrigerant piping system may include third pipe 408. The refrigerant piping system may include fourth pipe 406.

The first pipe 410 may have one or more features in common with first pipe 314. Second pipe 412 may have one or more features in common with second pipe 316. Third pipe 408 may have one or more features in common with third pipe 312. Fourth pipe 406 may have one or more features in common with fourth pipe 310.

All valves, controls, and accessories may be located in either an indoor unit and/or an outdoor unit.

Thus, HACD systems and methods of use are provided. Persons skilled in the art may appreciate that the present invention can be practiced by other than the described embodiments, which are presented for purposes of illustration rather than of limitation. The present invention is limited only by the claims that follow.

What is claimed is:

1. A heating, air conditioning, and dehumidification ("HACD") system comprising:
- an outdoor system, the outdoor system comprising:
- a compressor;
- a fully controlled condenser fan;
- a condenser coil;
- a 4-way reheat valve; and/or
- a 3-way reheat valve;
- an indoor system, the indoor system comprising:
- a hot gas reheat coil;
- a thermal expansion valve ("TXV");
- a check valve;
- a metering device;
- a blower motor; and
- a flat evaporator coil;
- a refrigerant; and
- a refrigerant piping system, the refrigerant piping system comprising:
  - a first pipe, the first pipe being a compressor discharge pipe, the first pipe being coupled from the compressor to the 3-way reheat valve, the 3-way reheat valve configured to output the refrigerant to the condenser coil and the hot gas reheat coil;
  - a second pipe, the second pipe being coupled, via the check valve, from the hot gas reheat coil to the condenser coil, the check valve configured to output the refrigerant to the condenser coil;
  - a third pipe, the third pipe being coupled, via the metering device, from an outlet of the condenser coil to an input of the flat evaporator coil, the metering device configured to output the refrigerant to the flat evaporator coil; and
  - a fourth pipe, the fourth pipe being a suction line pipe, the fourth pipe being coupled from an outlet of the flat evaporator coil to an input of the compressor, the fourth pipe configured to output the refrigerant to the compressor; and wherein:
- the hot gas reheat coil is located a threshold distance from the flat evaporator coil thereby avoiding a heat loss;
- the fully controlled condenser fan is configured to transport air over the condenser coil;
- the blower motor is configured to transport air over the flat evaporator coil;
- the TXV is configured to control an amount of refrigerant released into the flat evaporator coil; and
- the indoor system is configured to be confined to a form factor footprint such that physical dimensions of the indoor system are less than or equal to about 28×25.5×52 inches.

2. The HACD system of claim 1 wherein the refrigerant piping system comprises two pipes for conventional cooling and two pipes for heat extraction.

3. The HACD system of claim 1 wherein the HACD system does not use electric heat.

4. The HACD system of claim 1 wherein a use of the refrigerant piping system, with the fully controlled condenser fan, causes the refrigerant to be transported first to the hot gas reheat coil and then to the condenser coil.

5. The HACD system of claim 1 wherein, in a dehumidification mode, the outdoor condenser rejects additional heat accumulated from compressor motor heat gain, thereby maintaining a net neutral temperature of supply air in the indoor system.

6. The HACD system of claim 1 wherein switching between modes does not require shutting off the compressor, thereby avoiding delays, the modes including heating, cooling, and dehumidification.

7. The HACD system of claim 1 wherein the compressor is a variable-speed compressor, and further wherein the variable-speed compressor and the 4-way valve are configured to switch between modes without requiring shutting off the compressor.

8. The HACD system of claim 1 wherein the hot gas reheat coil is located above the blower motor, and located a threshold distance from the flat evaporator coil, thereby avoiding heat loss.

9. The HACD system of claim 1 wherein the indoor system further comprises an accumulator, the accumulator storing the refrigerant until the refrigerant is needed by the system and sending the refrigerant to the compressor when the refrigerant is needed by the system.

10. The HACD system of claim 1 wherein the indoor system is configured to be confined to a form factor footprint such that physical dimensions of the indoor system are less than or equal to about 20×20×40 inches.

11. A method of using a heating, air conditioning, and dehumidification ("HACD") system, the method comprising using:
- an outdoor system, the outdoor system comprising:
- a compressor;
- a fully controlled condenser fan;
- a condenser coil;
- a 4-way reheat valve; and/or
- a 3-way reheat valve;
- an indoor system, the indoor system comprising:
- a hot gas reheat coil;
- a thermal expansion valve ("TXV");
- a check valve;

a metering device;
a blower motor; and
a flat evaporator coil;
a refrigerant; and
a refrigerant piping system, the refrigerant piping system comprising:
a first pipe, the first pipe being a compressor discharge pipe, the first pipe being coupled from the compressor to the 3-way reheat valve, the 3-way reheat valve configured to output the refrigerant to the condenser coil and the hot gas reheat coil;
a second pipe, the second pipe being coupled, via the check valve, from the hot gas reheat coil to the condenser coil, the check valve configured to output the refrigerant to the condenser coil;
a third pipe, the third pipe being coupled, via the metering device, from an outlet of the condenser coil to an input of the flat evaporator coil, the metering device configured to output the refrigerant to the flat evaporator coil; and
a fourth pipe, the fourth pipe being a suction line pipe, the fourth pipe being coupled from an outlet of the flat evaporator coil to an input of the compressor, the fourth pipe configured to output the refrigerant to the compressor; and
wherein:
the hot gas reheat coil is located a threshold distance from the flat evaporator coil thereby avoiding a heat loss;
the fully controlled condenser fan is configured to transport air over the condenser coil;
the blower motor is configured to transport air over the flat evaporator coil;
the TXV is configured to control an amount of refrigerant released into the flat evaporator coil; and
the indoor system is configured to be confined to a form factor footprint such that physical dimensions of the indoor system are less than or equal to about 28×25.5×52 inches.

12. The method of claim 11 wherein the refrigerant piping system comprises two pipes for conventional cooling and two pipes for heat extraction.

13. The method of claim 11 wherein the method does not use electric heat.

14. The method of claim 11 wherein the use of the refrigerant piping system, with the fully controlled condenser fan, causes the refrigerant to be transported first to the hot gas reheat coil and then to the condenser coil.

15. The method of claim 11 wherein, in a dehumidification mode, the condenser causes accumulation of a threshold level of temperature cooling to overcome a compressor heat loss, thereby cooling a temperature of supply air in the indoor system.

16. The method of claim 11 wherein switching between modes does not require use of the compressor, thereby avoiding delays, the modes including heating, cooling, and dehumidification.

17. The method of claim 11 wherein the compressor is a variable-speed compressor, and further wherein the variable-speed compressor and the 4-way valve are configured to switch between modes without requiring shutting off the compressor.

18. The method of claim 11 wherein the hot gas reheat coil is located above the blower motor, and located a threshold distance from the flat evaporator coil, thereby avoiding heat loss.

19. The method of claim 11 wherein the indoor system further comprises an accumulator, the accumulator storing the refrigerant until the refrigerant is needed by the system and sending the refrigerant to the compressor when the refrigerant is needed by the system.

20. The method of claim 11 wherein the indoor system is configured to be confined to a form factor footprint such that physical dimensions of the indoor system are less than or equal to about 20×20×40 inches.

* * * * *